US006935154B2

(12) United States Patent
Calder et al.

(10) Patent No.: US 6,935,154 B2
(45) Date of Patent: Aug. 30, 2005

(54) METHOD FOR LOCATING VARIABLE LENGTH COMPONENTS IN A MODULAR FORMING DIE

(75) Inventors: David Patrick Calder, Baltimore, MD (US); Albert Randy Wolfe, Bel Air, MD (US)

(73) Assignee: General Electric Company, Schenectady, NY (US)

( * ) Notice: Subject to any disclaimer, the term of this patent is extended or adjusted under 35 U.S.C. 154(b) by 79 days.

(21) Appl. No.: 10/742,425

(22) Filed: Dec. 19, 2003

(65) Prior Publication Data

US 2004/0168501 A1 Sep. 2, 2004

Related U.S. Application Data

(62) Division of application No. 09/764,594, filed on Jan. 18, 2001, now Pat. No. 6,711,931.

(51) Int. Cl.[7] ..... B21D 11/02; B21D 11/22; B21D 17/02

(52) U.S. Cl. ..... 72/461; 72/301; 72/414; 72/389.3

(58) Field of Search ..... 72/295, 301, 389.3, 72/414, 461

(56) References Cited

U.S. PATENT DOCUMENTS

| | | | | | |
|---|---|---|---|---|---|
| 2,479,161 | A | * | 8/1949 | Hall | 72/314 |
| 2,670,779 | A | * | 3/1954 | Mowrey | 72/301 |
| 2,886,092 | A | * | 5/1959 | Jelinek | 72/301 |
| 3,827,278 | A | * | 8/1974 | Mershon et al. | 72/430 |
| 4,276,762 | A | * | 7/1981 | Mershon et al. | 72/430 |
| 4,411,150 | A | * | 10/1983 | Klein et al. | 72/461 |
| 4,444,037 | A | * | 4/1984 | Norgate | 72/414 |
| 4,700,483 | A | * | 10/1987 | Tsujiuchi et al. | 33/706 |
| 5,865,056 | A | * | 2/1999 | Nagakura | 72/461 |
| 6,101,859 | A | * | 8/2000 | Shieh | 72/414 |
| 6,212,933 | B1 | * | 4/2001 | Aoki | 72/461 |
| 6,711,931 | B2 | * | 3/2004 | Calder et al. | 72/301 |

* cited by examiner

*Primary Examiner*—David B Jones
(74) *Attorney, Agent, or Firm*—McNees Wallace & Nurick LLC; K. Scott O'Brian; Carmen Santa Maria

(57) ABSTRACT

An apparatus and a method for accurately and repeatably positioning metallic parts having variable length extrusions and shaped sheet metal in a modular die system that forms a joggle in the metallic parts. The apparatus of the present invention includes a standard joggle die system that is currently in use in the art. The apparatus further includes a movable back gage assembly that works in combination with the joggle die system to allow an operator to accurately position the workpiece between the joggle dies at a preselected position. The back gage assembly is movable in both the horizontal and vertical directions. The back gage assembly moves into a stored position away from the working area of the dies to permit the joggle to be formed in the workpiece. The back gage assembly can then move back into the working area to accurately position the next workpiece without the need for further adjustments.

12 Claims, 6 Drawing Sheets

METHOD FOR LOCATING VARIABLE LENGTH COMPONENTS IN A MODULAR FORMING DIE

This application is a Division of Ser. No. 09/764,594, filed Jan. 18, 2001, now U.S. Pat. No. 6,711,931.

FIELD OF THE INVENTION

The present invention is directed to equipment used in metal forming operations, and specifically to equipment that automatically positions metal extrusions or shaped sheet in a modular die system for forming an offset pattern.

BACKGROUND OF THE INVENTION

Sheet metal parts in the form of extrusions and shaped sheet are often used in aircraft structures for structural assemblies. These metal component parts are relatively thin, usually about 3/16" maximum, and most typically between about 1/8" to about 1/16" in thickness. The component parts may be thinner than 1/16", the thickness being dictated by the application. These structural assemblies can be intricate internal assemblies or assemblies such as fuselage structures, wing structures, nacelles or thrust reversers. In order to properly assemble these structures, it is necessary to further form the extrusions and shaped sheet to have joints that permit proper fit-up as well as strength. These joints are formed by using a die assembly to form a joggle in the extrusion or shaped sheet.

A joggle is an offset in a flat plane consisting of at least two bends in opposite directions in which material is displaced into a new plane that is parallel to the original plane. The joggle forms a new plane from the original material that is substantially parallel to the plane of the original shaped sheet or extrusion. Joggles are formed by placing the shaped sheet metal or extrusions in a die to form the desired joint configuration. These joggles are then assembled to similar or identical joggles in mating parts that allow for proper fit-up and assembly of the mating parts. Typically, the dies are modular die systems. While the shaped sheet or extrusions may have joggles formed by cold working, that is, forming the joggle at ambient temperature, the joggles more frequently are formed by heating the workpiece to elevated temperatures by using heated dies.

Many of the sheet metal parts utilized in aircraft applications include titanium and titanium alloys as well as aluminum and aluminum based alloys such as aluminum alloy designated as 7075. Joggles are hot formed in extrusions and shaped sheet of this alloy by manually positioning the extrusion or shaped sheet in contact with a heated die in a forming press. The dies are modular and are interchangeable, the specific die system used depending upon the extrusion or shaped sheet that is supplied and the location and shape of the joggle required. The length of the extrusion or shaped sheet into which the joggle is to be formed is not restricted, although the joggle is typically formed near the end of the part. Typically, a joggle is formed within about two feet of one end of the extrusion or shaped sheet, as this is the location of fit-up with a mating part. However, the die system and forming press may be designed to form a joggle at greater distances from an end of the extrusion or shaped sheet.

The current practice for aligning an extrusion, shaped sheet or other workpiece in a forming press is for the operator to manually position the part inside of a preselected heated die. A combination square having a right angle and a scale along at least one edge is positioned against a die surface, and the workpiece is positioned adjacent to, or in contact with, the end of the scale on the combination square to allow the operator to properly align the workpiece in the forming press. This method is both inefficient and hazardous. It is hazardous as it requires the operator to perform hand alignment of the workpiece inside or adjacent to heating dies that have been heated to an elevated temperature, typically about 300° F.–370° F. for aluminum alloy 7075. The temperature will vary depending upon the alloy used, and may be higher or lower, but will always be sufficiently high for forming and capable of causing burns to a careless operator. In addition, proper alignment may entail the operator placing his/her hands within the die assemblies of the forming press, thereby exposing a careless operator to potential injury by placing hands within pinch points. In addition to the dangers with the present system, it is also inaccurate. The workpiece is aligned visually and by hand by an operator against a scale having linear gradations that are 1/32" (0.031") or 1/64" (0.015") apart, requiring the operator to estimate the correct location of the workpiece within the die. Furthermore, as the workpiece becomes longer and with a portion of the workpiece extending beyond the die, it becomes more difficult for the operator to correctly estimate the location of the portion of the workpiece into which the joggle is to be formed as the operator must attempt to align a location marker applied to the workpiece with a parting line in the die that is used to form the joggle. Not only is the system limited by the instrumentation, but also additional error easily can be introduced by failure of the operator to properly align the workpiece against the scale. Clearly, due to the inherent inaccuracies, the current system can reasonably be controlled from about 1/64" to about 1/16" depending upon the skill of the operator and the degree of care expended by the operator. The current system does not produce repeatable results within tolerance limits typically desired for fit-up and assembly of aircraft components. When controlled tolerances are required, additional manufacturing operations must be included.

Currently, when accuracy is required in the location of a joggle, a workpiece having an excess of material is positioned in the die assembly and the joggle is formed in the workpiece in the conventional manner. After removal of the joggled workpiece from the die assembly, the excess material is then machined from the workpiece and the workpiece is measured to determine the proper location of the joggle, and re-machined as required.

What is needed is an accurate, repeatable system to position a workpiece formed of extruded metal or shaped sheet metal in a die system for forming joggles that reduces the inaccuracies inherent in the current system in aligning the workpiece, allowing for repeatable and precise alignment of the workpiece in relation to the die system.

SUMMARY OF THE INVENTION

The present invention provides an apparatus and a method for accurately and repeatably positioning metallic parts comprised of variable length extrusions and shaped sheet metal in a modular die system that forms a joggle in the metallic parts.

The apparatus of the present invention is comprised of a standard joggle die system that is currently in use in the art. The joggle die system permits a joggle to be formed in a metallic part. These metallic parts or workpieces are extrusions or shaped sheet metal parts that require additional metal forming operations so that they can be used for specific applications.

A joggle is an offset that is placed in a workpiece, typically an extrusion. It provides a work surface that is out of the plane of the original work surface. While there is no requirement that a joggle provide a work surface that is parallel to the work surface of the original workpiece, a joggle typically does offset the surface to provide such a parallel workpiece. The joggle typically is formed near the end of the workpiece and permits the offset plane formed in the workpiece to be mated with another workpiece, thereby allowing the parts to be joined by a manner such as by riveting or bolting. The offsets are formed by application of pressure by means of a set of forming dies in a press. The forming dies can be arranged to change the depth of the offset or joggle. Rotation of portions of the dies can also change the radius of the joggle, as can the shape of the dies. Joggles can be formed in a variety of materials having different thicknesses. Joggles have been formed in materials in thicknesses of up to one inch. As the thickness of the material increases and as the tensile strength of the material increases, the pressure required to form a joggle becomes greater and the strength requirements of the dies increases. While joggles may be formed in materials such as aluminum and titanium in thicknesses of up to one inch, more typically joggles are formed in materials having thicknesses of about ⅛" and less.

The present invention utilizes a back gage assembly in combination with the joggle die system to permit accurate placement of the joggle in the workpiece. The back gage assembly includes a movable back gage plate. The back gage plate is movable in a horizontal direction and in a vertical direction. The joggle die system includes at least a pair of movable dies that can be moved from an open position for receiving and removing the workpiece, and a closed position for retaining the workpiece. Clamps may be utilized to grasp the work piece to prevent movement of the workpiece in the dies during the joggle forming operation, or the dies solely may provide the required clamping force. The die assembly may include at least one heating element for heating the die system to a preselected temperature. Upon placing the workpiece in the die system for a preselected period of time, heat will be transferred from the dies to the workpiece to elevate the temperature of the workpiece so that the joggle operations can be a hot working operation. However, the joggle may be formed at room temperature, if required.

The back gage plate is movable in a horizontal direction from an open or stored position to a predetermined position that is related to the dies, and the back gage plate itself may be attached to a movable elongated member. This predetermined position determines the workpiece location at which the joggle will be formed. Before the workpiece is clamped between the dies, the back gage plate is moved to a predetermined position by a means that will accurately position the back gage plate in a horizontal direction and thereby accurately locate the workpiece between the dies. The vertical position of the back gage plate is adjusted by means that will position the back gage plate in a vertical direction so that it can contact at least one surface of the workpiece, but so that it is out of contact with the dies. After the workpiece is brought into contact with the back gage plate, the workpiece is firmly clamped into position and the back gage plate is moved horizontally to a stored position in which it is retracted away from the dies.

After the workpiece has been firmly clamped into position, the joggle die assembly can be activated to apply pressure to the workpiece and form a joggle in the die accurately at a preselected position of the workpiece.

An advantage of the present invention is that the back gage assembly permits accurate location of the joggle in the workpiece. The back gage assembly also permits a repeatable location of the joggle assembly in a plurality of workpieces. This accurate and repeatable positioning of the workpiece in the die assembly by the back gage assembly eliminates operator error previously associated with the positioning of the workpiece in the die assembly, thereby reducing scrap.

A further advantage of the present invention is that the back gage assembly increases productivity. In addition to the reduction of scrap due to operator error in placement of the workpiece in the die assembly, the amount of time spent in properly locating the work-piece in the die assembly is also reduced, so that the number of pieces that can be processed in a unit time can be increased.

Still another advantage of the present invention is that a machining operation utilized to precisely locate the joggle in an oversized workpiece can be eliminated. The elimination of this operation will also further increase the productivity as a time-consuming precision machining operation can be eliminated.

Yet another advantage of the present invention is that the operator no longer required to place his hands between the hot forming dies in order to accurately align the workpiece with a scale. Not only is the possibility of contact with the hot dies significantly reduced, but also the positioning of the operator's hands between potential pinch points and subsequent injury doe to machine malfunction or inadvertent activation is eliminated.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts.

DETAILED DESCRIPTION OF THE INVENTION

Figure 1:
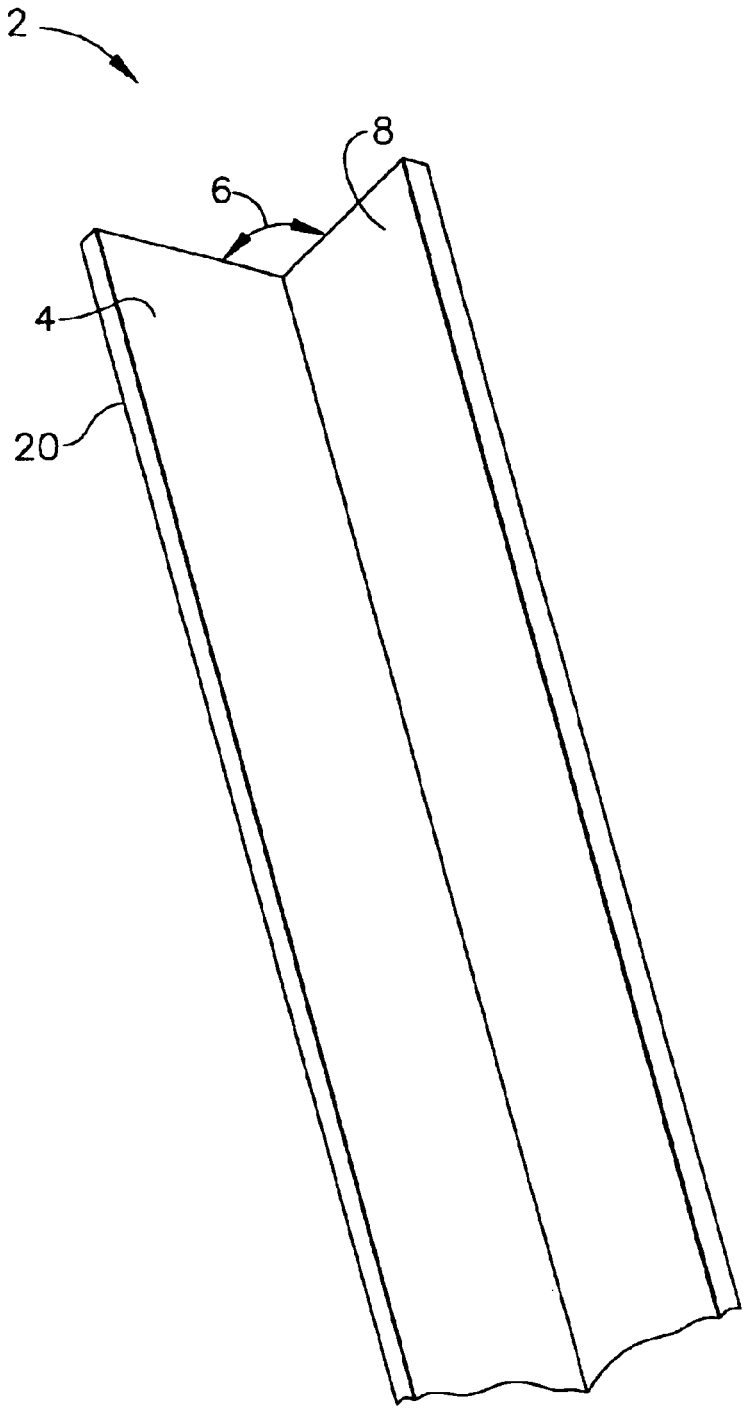
FIG. 1 is a perspective view of a sheet metal extrusion.
Figure 2:
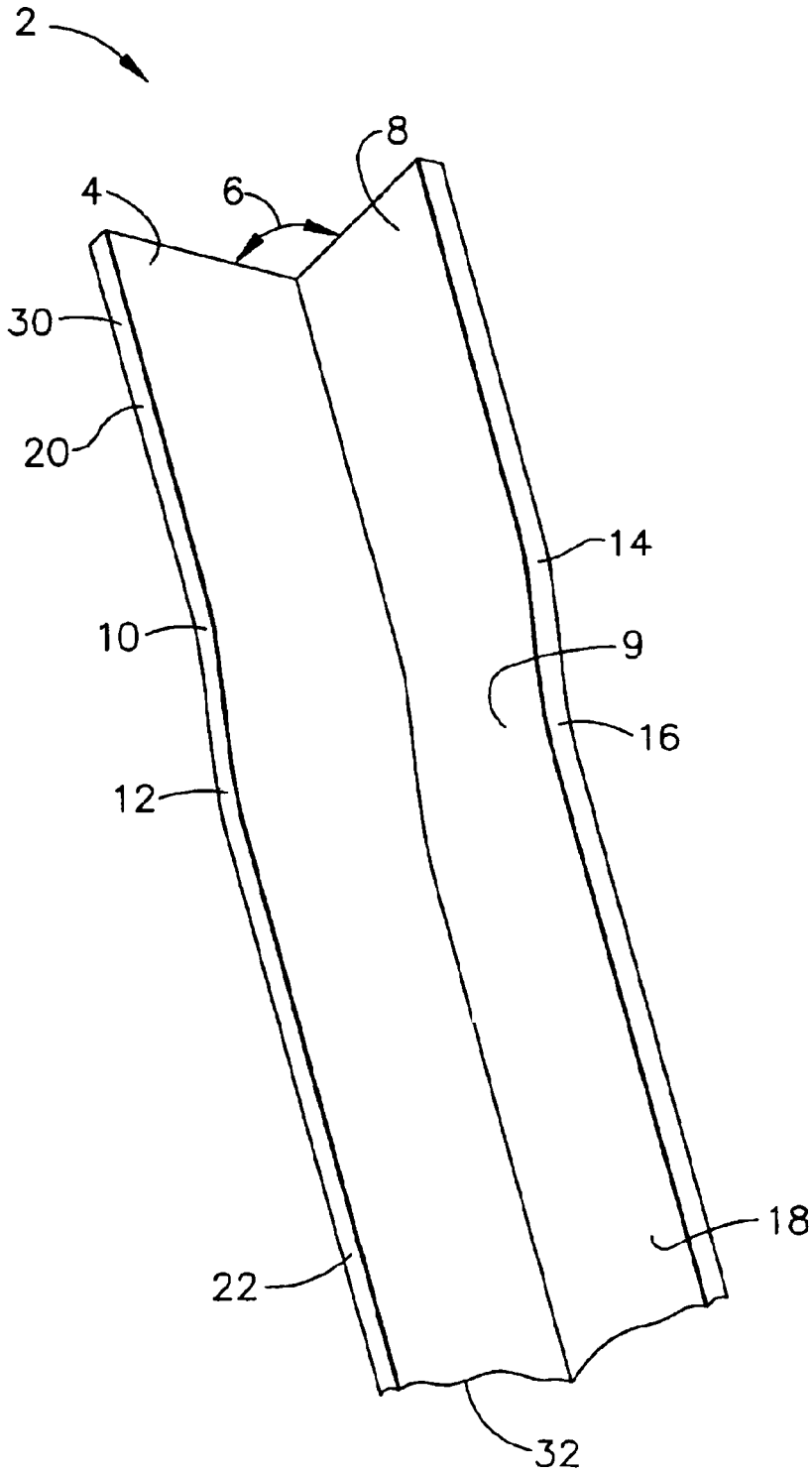
FIG. 2 is a perspective view of a sheet metal extrusion after a joggle has been formed therein.

The present invention provides an apparatus and a method for accurately and repeatably positioning a metal workpiece in a joggle die assembly for formation of a joggle. The workpiece typically may be extruded metal or shaped sheet. FIGS. 1 and 2 depict a joggle formed in a piece of extruded metal. An extruded metal workpiece 2 is depicted as an L-shaped extrusion in FIG. 1, having a first leg 4 oriented at an angle 6 to a second leg 8. Angle depicted in FIG. 1 is a right angle, but angle 6 is not restricted to a right angle. FIG. 2 depicts the extruded workpiece having a joggle 9 formed in extruded workpiece 2 between points 10, 12, 14, and 16. The deformation of extruded workpiece 2 produces joggle 9 and results in the creation of a planar surface 18 parallel to planar surface 8 in FIG. 2 connected by joggle 9. Both joggle 9 and second planar surface 18 were originally part of planar surface 8 of FIG. 1. While surface 4 remains a unitary coplanar surface after the formation of joggle 9, a portion of original edge 20 is displaced by joggle 9 to form second edge 22 that is coplanar and connected to original edge 20 via joggle 9.

Joggle 9 is positioned at a predetermined distance from a first end 30 of extrusion 2. A second end 32 of extruded workpiece 2 can be at any variable distance from first end 30 of extruded workpiece 2. Joggle 9 is formed at the predetermined distance from first end 30 by a joggle die system 38 as shown schematically from an overhead position in FIG. 3. The workpiece, extrusion 2, is secured between a set of joggle dies 40, 42 as joggle dies are moved from an open position to a closed position, and joggle 9 is formed as movable portions 44, 46 of dies 40 and 42 are moved from a non-engaged position to the engaged position shown in FIG. 3, forming joggle 9.

Figure 4:
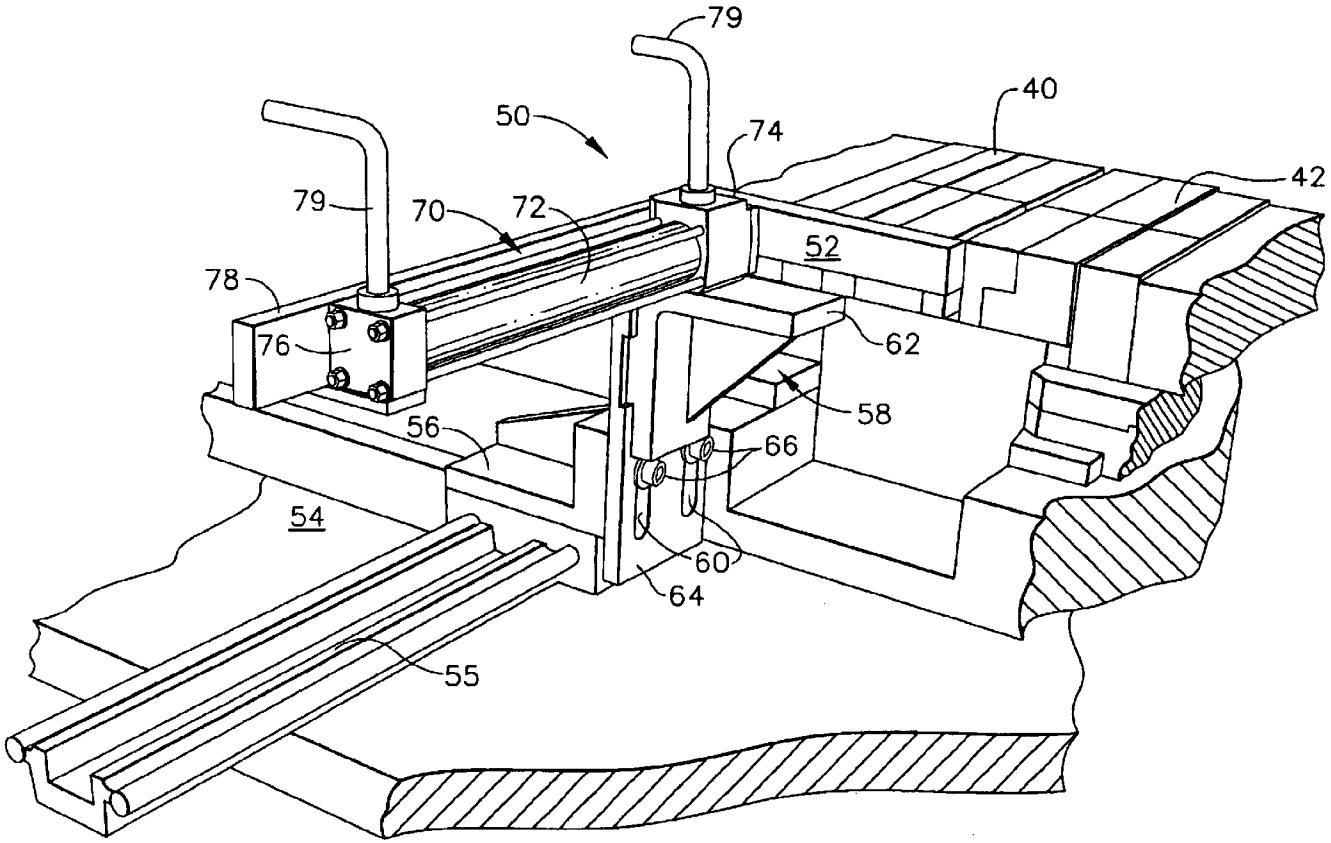
FIG. 4 is a schematic view of the back gage assembly of the present invention.

The precise location of joggle 9 from first end 30 is accomplished by use of the back gage assembly 50 of the present invention depicted schematically in FIG. 4. In a preferred embodiment a back gage plate 52 is assembled in relationship to a linear slide table 54. Back gage plate 52 is comprised of a rigid material that has a face 53 that has sufficient area to firmly make contact with any configuration of a workpiece that is to be assembled between joggle dies 40, which are shown in relation to back gage assembly 50 in FIG. 4. Linear slide table assembly 54 is comprised of a slide mechanism 55 and a linear slide table 56 that can be fixed and locked into position with respect to joggle dies 40, 42. Slide table 56 is assembled onto slide mechanism 55 and can translate along slide mechanism 55. The positioning of linear slide table 56 in relationship to joggle dies 40, 42 determines the positioning of back gage plate 52 which in turn determines the position of the workpiece in joggle dies 40, 42. Currently, in the best mode of practicing the invention, the front of slide table 56 is fixed in relation to the center of the joggle dies 40, 42 with a linear scale. Use of a linear scale allows the accuracy of the positioning of the slide table in relation to the center of the joggle dies to be controlled within the gradations of the linear scale. Thus, the use of a linear scale having gradations of 1/64" (about 0.015") allows for an accuracy of at least one half the distance between gradations, or reasonably about 0.010". Slide table 56 is locked into position with a cam lock, not shown, upon proper positioning. The datum points for setting the relationship between slide table 56 and joggle dies 40, 42 are arbitrary, and any fixed positions may be used. However, the center of joggle dies 40, 42 is a convenient choice, as the center of joggle dies 40, 42 is typically the location wherein the joggle is formed, even though different joggle dies are used to form different joggles in workpieces of varying configuration. In a preferred embodiment, the linear scale may be replaced by a calibrated movable threaded screw that can be rotated to precisely position linear slide table 56. A calibrated movable thread can allow control of the accuracy of the positioning to within 0.001". The location of the linear slide table 56 can be determined by a dial indicator or a digital read-out indicative of position. The method of determining the location of linear slide table 56 in relationship to the center of the dies is not critical and any well-known positioning means may be used. As further examples, a linear actuator in conjunction with a hydraulic drive may be used to position and move linear slide table 56. Alternatively, slide table 56 may be moved by means of an electric motor, and positioning of slide table 56 may be accurately accomplished by a laser. The cost of the equipment required to achieve the accuracy increases with increasing accuracy, an accuracy of 0.0001" can be achieved with laser devices or ultrasonic measuring equipment if the application justifies the expenditure for such sophisticated equipment. The accuracy and repeatability required for the vast majority of applications can be achieved with the use of a linear scale or a calibrated adjustable screw drive positioning device, as the accuracy of the placement of the joggle using the back gage assembly as a positioning system is dictated by the tolerances used in manufacturing the die assemblies, and not by the back gage assembly. Thus, high cost/high accuracy measuring devices for the positioning system currently would not improve accuracy of the system because of the other limitations. Accurately positioning of the joggle from 0.001"–0.010" using the back gage assembly system, and to about 0.005" provides a significant improvement as compared methods used prior to use of the back gage assembly system. As noted, the means for moving and accurately positioning linear slide table 56 may be accomplished by any known techniques, the above exemplary techniques being illustrative. Although not part of the present invention, the radii formed in the metal, the amount of metal deformation and the location of the joggle can be varied by changing joggle dies. Furthermore, a change in workpiece configuration can also require a change in the joggle dies.

Referring again to FIG. 4, an angle bracket assembly 58 is positioned to support a hydraulic cylinder assembly 70 to which it is affixed. Hydraulic cylinder assembly 70 is affixed to back gage plate 52, the activation of said cylinder assembly 70 providing means for translating back gage plate 52 and hence the back gage assembly 50 from a first stored position to a second engaged position. Hydraulic cylinder assembly 70 can be attached to angle bracket assembly by any convenient means such as by fastening or by tack welding. Hydraulic cylinder assembly 70, in the best mode shown in FIG. 4, is comprised of hydraulic cylinder rod 72, which is threaded through first end cap 74 and attached to back gage plate 52, such as by threading into back gage plate 52. In the embodiment shown in FIG. 4, cylinder rod 72 is threaded into a second end cap 76 at the end of rod 72 opposite back gage plate 52. The means of attachment of the rod to either the end caps or to the back gage plate 52 is not critical. These attachments may be made by welding or threading and may include added features such as flanges with apertures and counterbores that may include threaded features, none of the details of such attachment means being critical to the operation of the invention. However, ease of assembly and disassembly is facilitated by threaded connections. A guide mechanism 78 extends between first end cap 74 and second end cap 76, next to cylinder rod 72, to prevent rotation of end caps 74, 76 when cylinder rod 72 is actuated. Hydraulic lines 79 are connected to hydraulic cylinder rod 72 through end caps 74, 76, and are also connected to a hydraulic sequencing valve, not shown, that provides a momentary delay in the retraction of back gage assembly 50 from the engaged position until the workpiece has been clamped by clamping devices. This slight delay ensures that there is no inadvertent movement of a workpiece until it is properly secured by the clamping devices.

Angle bracket assembly 58, in addition to providing a support surface for hydraulic cylinder assembly 70, also provides means for vertically adjusting the height of the back gage assembly. In the embodiment shown in FIG. 4, angle bracket assembly 58 includes a right angle bracket 62 attached to a vertical adjustment plate 64 that includes at least one vertical slot 60. Vertical adjustment plate 64 is movable in a vertical plane with respect to right angle bracket 62 so as to position right angle bracket at a preselected vertical position. Vertical adjustment plate 64 also attaches to linear slide table 56. At least one bolt 66 is threaded through the at least one vertical slot 60 in vertical adjustment plate 64. In the embodiment shown in FIG. 4, vertical adjustment plate 64 includes two vertical slots 60 and two locking devices extending through the slots in the form of two bolts 66 that are threaded into a supporting structure, linear slide table 56 as shown in FIG. 4. The vertical adjustment of back gage plate 52 is achieved by moving the vertical adjustment plate 64 and right angle bracket 62 to the desired position, which preferably places back gage plate 52 at a height which is in contact with an end of the workpiece (not shown) but out of contact with the joggle dies 40, 42. Tightening of bolts 66 into linear slide table 56 and the bolt heads against adjustment plate 64 fixes the vertical position of the back gage plate 52. While the best mode of practicing the invention is set forth in the embodiment shown in FIG. 4, in a preferred embodiment, adjustment of the vertical position of the back gage assembly 50 is accomplished by a mechanical means in which the back gage assembly 50 is positioned by use of hydraulically activated cylinders or electrically powered motors, thereby further reducing the exposure of the operator to the die region. In one exemplary embodiment, a threaded screw is attached to either electrically powered motors or hydraulically activated cylinders which move the threaded screw. Monitoring equipment that can include linear actuators or dial indicators provides feedback to determine the position of the back gage assembly 50 with respect to a preselected datum so that the screw movement can be inactivated upon the back gage assembly 50 achieving the desired vertical position. Thus, the vertical adjustment of the back gage assembly 50 may be achievable by modification or elimination of some or all of the elements of the angle bracket assembly 58. It will be understood that angle bracket assembly 58 shown in the embodiment of FIG. 4 is only one means of accomplishing vertical adjustment of back gage assembly.

Figure 5:
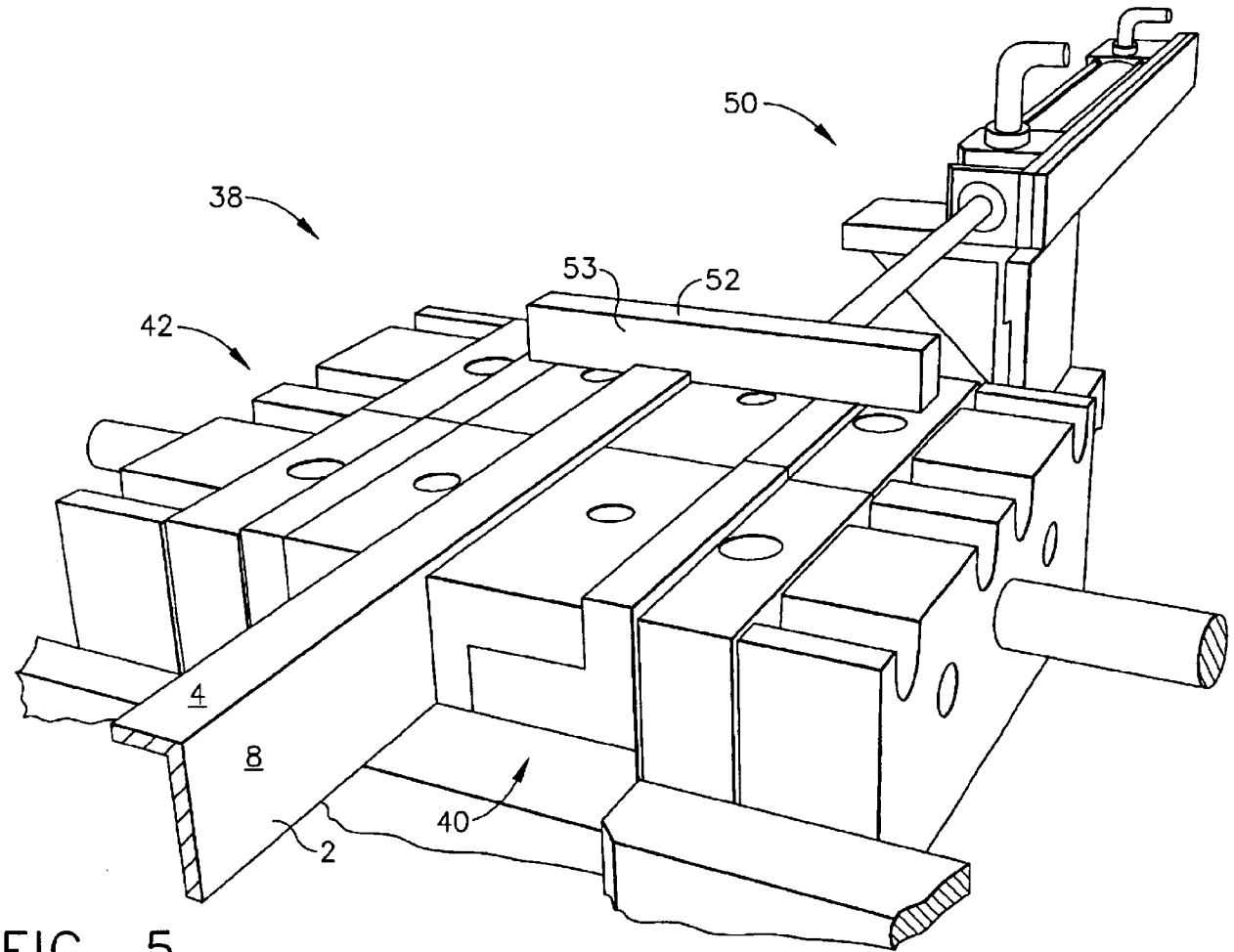
FIG. 5 is a schematic view of an extrusion assembled into a set of joggle dies with the back gage assembly in the extended position so that the back gage plate is in contact with the extrusion.

In operation, the required joggle die assembly is assembled into a press. The vertical height of back gage plate 52 within back gage assembly 50 is adjusted so that it will contact a workpiece, but not contact joggle dies 40, 42. The horizontal position of the back gage plate 52 is determined by adjusting linear slide table 56 of back gage assembly 50 in relation to the center of joggle dies 40, 42 and locking linear slide table 56 into position. Then, workpiece 2 is placed into joggle die assembly 38 and against face 53 of back gage plate 52 of back gage assembly 50 as shown in FIG. 5. If necessary, additional adjustments are made to the vertical height of back gage plate 52. Workpiece 2 is next clamped into die assembly 38 by clamping means (not shown) in preparation of the joggle die forming operation. As workpiece 2 is clamped in the joggle die assembly, back gage assembly 50 preferably automatically moves into its extended position in contact with workpiece 2 shown in FIG. 5 to its stored refracted position away from workpiece 2 and outside of the working region of the press (not shown). Workpiece remains in contact with the heated dies for a predetermined time to allow workpiece to reach a uniform working temperature. For example, for aluminum alloy 7075T6, where T6 indicates a temper condition of the aluminum alloy, the dies are maintained at a temperature of 300–365° F. In this example, the joggle could be cold formed in aluminum alloy 7075-0 (temper condition T-0), but additional heat treatment operations would be required prior to placing the material in service. First, the 7075 must be heat-treated to temper T-3 and then aged to condition T-6. If the starting material is 7075T-3, a subsequent aging treatment to condition T-6 is required. Thus, the advantage of forming the joggle by hot working a material such as aluminum alloy 7075-T6 becomes evident. Activation of the press (not shown) which is the means for applying pressure in one of the standard joggle systems causes the cycling of the dies and the formation of the joggles.

Figure 3:
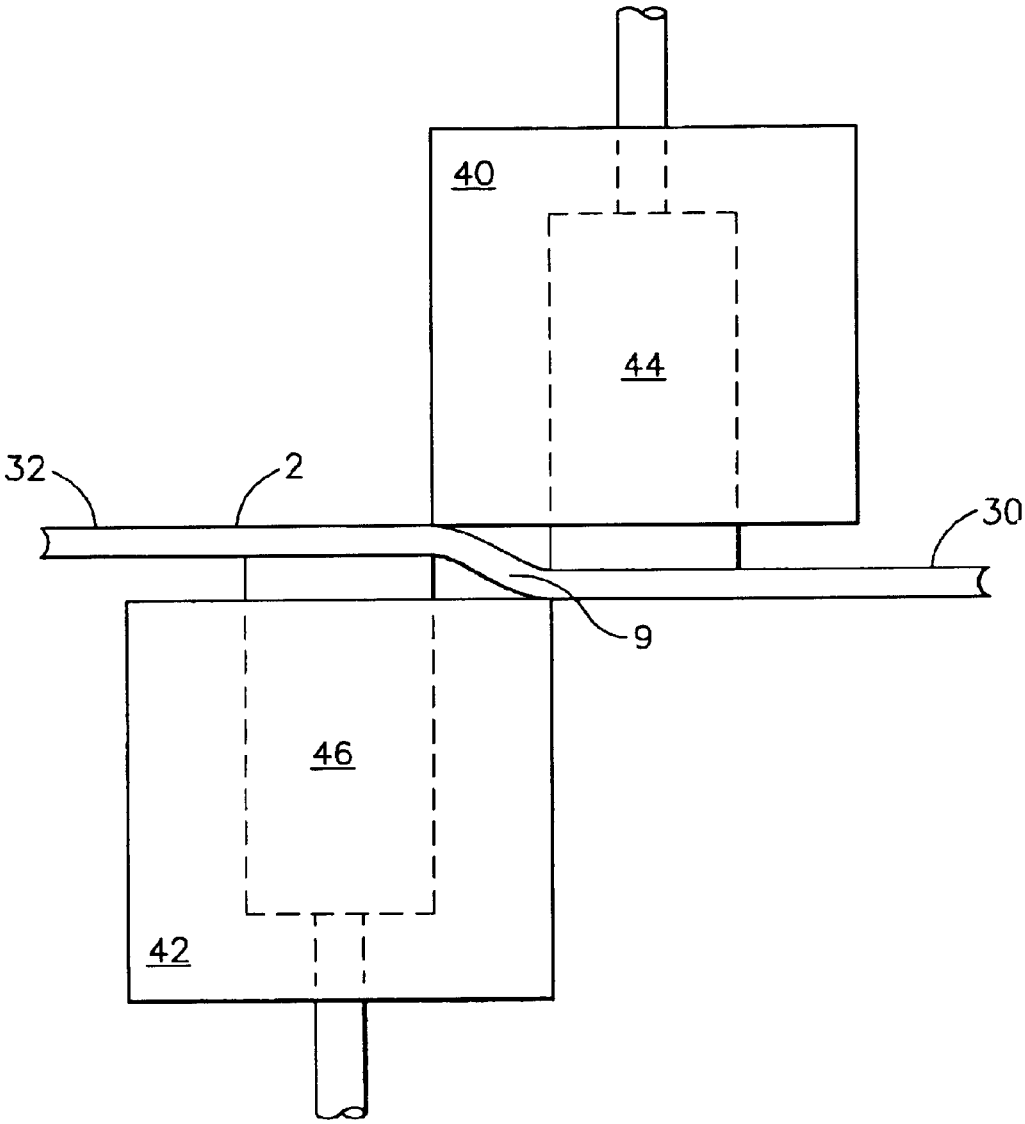
FIG. 3 is a perspective view of a typical set of joggle dies.
Figure 6:
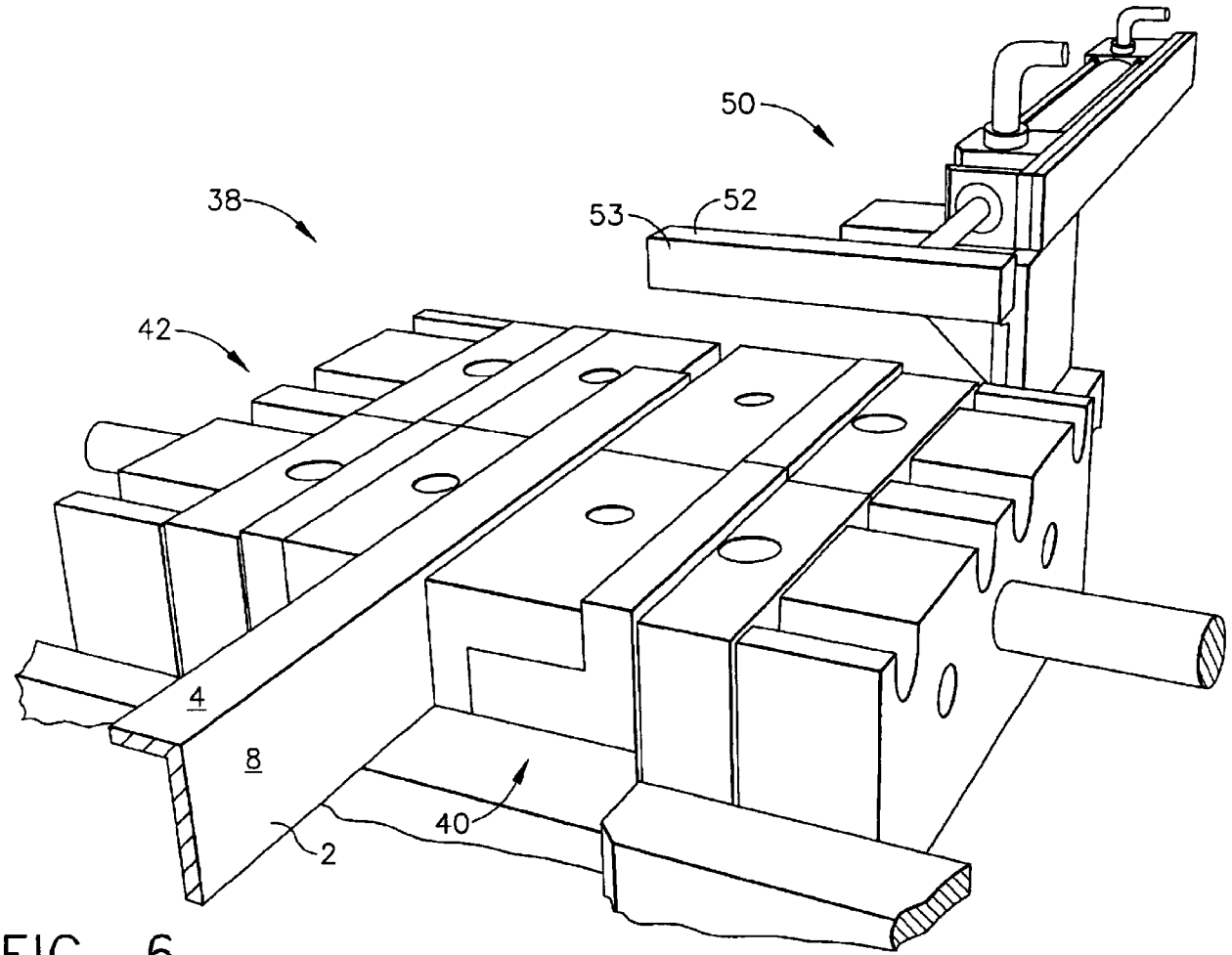
FIG. 6 is a schematic view of an extrusion assembled into a set of joggle dies with the back gage assembly in the retracted position so that the back gage plate is out of contact with the extrusion.

While automatic cycling is preferred, a manually activated command from an operator to retract back gage assembly 50 will also accomplish the step of moving assembly 50 from the working area of the press (not shown) away from die assembly 38. Back gage assembly 50 is shown in retracted or stored position in FIG. 6 with back gage plate 52 out of contact with workpiece 2. This feature prevents an inadvertent cycling of joggle die assembly 38 while back gage assembly 50 is in its extended position within the working area of joggle die assembly 38, thereby preventing damage to workpiece 2, back gage assembly 50 and the joggle die assembly 38. Joggle dies 40, 42 are cycled as depicted in FIG. 3 thereby forming a joggle in workpiece 2 as illustrated in FIG. 2. Workpiece 2 is removed and additional workpieces can be assembled into joggle die assembly 38 without further need to adjust back gage assembly 50, and joggle dies 40, 42 will produce joggles in the same location for each workpiece. Back gage assembly 50 guarantees reproducibility of every workpiece cycled through the joggle die assembly 38 without the need to meticulously hand align each workpiece assembled into the joggle die assembly 38. Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A method for accurately positioning a workpiece in a joggle die system, comprising the steps of:

placing the workpiece between a set of joggle dies in the joggle die system;

moving a back gage plate assembly that includes a back gage plate into contact with the workpiece;

adjusting the back gage plate to a preselected position out of contact with the joggle dies and in contact with the workpiece;

adjusting the position of the back gage plate assembly in relation to a datum position on the joggle dies to a preselected position to accurately position the workpiece between the dies so that a joggle can be formed at a preselected location of the workpiece;

locking the back gage plate assembly into the preselected position;

clamping the workpiece into place between the joggle dies;

moving the back gage plate to a stored position outside of a working area of the dies; and cycling the joggle dies to form a joggle at the preselected location of the workpiece.

2. The method of claim 1 further including a step of heating the workpiece to a preselected temperature prior to cycling the joggle dies.

3. The method of claim 1 wherein the step of moving the back gage plate assembly into contact with the workpiece includes moving the back gage plate assembly horizontally into contact with the workpiece.

4. The method of claim 1 wherein the step of adjusting the back gage plate to a preselected position includes adjusting the back gage plate to a preselected vertical position.

5. The method of claim 1 wherein the step of moving the back gage plate to a stored position includes moving the back gage plate horizontally to a stored position.

6. The method of claim 1 further including an additional step, before the step of placing the workpiece between a set of joggle dies in the joggle die system, of moving a set of joggle dies in the joggle die system to an open position.

7. The method of claim 1 further including additional steps, after the step of cycling the joggle dies to form a joggle at the preselected location of the workpiece, of unclamping the workpiece from between the joggle dies;

placing a second workpiece substantially identical to the first workpiece between the joggle dies;

moving the back gage plate from the stored position outside of the working area of the dies to position the second workpiece;

clamping the workpiece between the dies; and, repeating the joggle forming operation.

8. The method of claim 7 wherein the step of moving the back gage plate from the stored position includes moving the back gage plate horizontally from the stored position.

9. A method for positioning a workpiece in a joggle die system, comprising the steps of:

placing the workpiece between the joggle dies in the joggle die system;

moving a back gage plate assembly that includes a back gage plate horizontally into contact with the workpiece;

adjusting the back gage plate to a preselected vertical position out of contact with the joggle dies and in contact with the workpiece;

adjusting the position of the back gage plate assembly in relation to a datum position on the joggle dies to a preselected position to accurately position the workpiece between the dies so that a joggle can be formed at a preselected location of the workpiece;

locking the back gage plate assembly into the preselected position;

clamping the workpiece into place between the joggle dies;

horizontally moving the back gage plate to a stored position outside of a working area of the dies; and cycling the joggle dies to form a joggle at the preselected location of the workpiece.

10. The method of claim 9 further including a step of heating the workpiece to a preselected temperature prior to cycling the joggle dies.

11. The method of claim 9 her including an additional step, before the step of placing the workpiece between a set of joggle dies in the joggle die system, of moving a set of joggle dies in the joggle die system to an open position.

12. The method of claim 9 further including additional steps, after the step of cycling the joggle dies to form a joggle at the preselected location of the workpiece, of unclamping the workpiece from between the joggle dies;

placing a second workpiece substantially identical to the first workpiece between the joggle dies;

moving the back gage plate from the stored position outside of the working area of the dies to position the second workpiece;

clamping the workpiece between the dies; and, repeating the joggle forming operation.

* * * * *